United States Patent [19]

Church

[11] 4,275,818

[45] Jun. 30, 1981

[54] PAINT BRUSH HOLDER AND WIPER

[75] Inventor: Robert F. Church, Windsor Locks, Conn.

[73] Assignee: The Paint Brush Holder Company, Farmington, Conn.

[21] Appl. No.: 110,837

[22] Filed: Jan. 10, 1980

Related U.S. Application Data

[63] Continuation-in-part of Ser. No. 28,998, Apr. 11, 1979, abandoned.

[51] Int. Cl.[3] ..... A46B 17/02

[52] U.S. Cl. ..... 220/90; 15/257.05; 248/110

[58] Field of Search ..... 220/90, 90.2, 90.4, 220/90.6; 248/110; 15/257.05

[56] References Cited

U.S. PATENT DOCUMENTS

| | | | |
|---|---|---|---|
| 2,542,737 | 2/1951 | Vogel | 220/90 |
| 2,676,730 | 4/1954 | Hedglon | 220/90 |
| 2,919,828 | 1/1960 | Lemke | 220/90 |
| 3,275,187 | 9/1966 | Lamoureaux | 220/90 |
| 3,776,415 | 12/1973 | Pfeffer | 220/90 |
| 3,948,413 | 4/1976 | Gorrell et al. | 220/90 |
| 4,014,453 | 3/1977 | Tarnacki | 220/90 |
| 4,101,046 | 7/1978 | Puntillo | 220/90 |

*Primary Examiner*—Steven M. Pollard
*Attorney, Agent, or Firm*—Hayes & Reinsmith

[57] ABSTRACT

A paint brush holder and wiper adapted for easy attachment and detachment from a paint can, roller tray or the like is disclosed. The holder includes a base, a holder disposed within the base for attaching the handle of a brush thereto, a pair of spaced apart side plates each fixedly attached to side edges of the base and having a leg adapted for supporting the holder against the outside surface of a paint can or the like and a finger disposed in a spaced apart relationship with the leg adapted for engaging a rim of a paint can or the like. The fingers and the legs cooperate to securely attach the holder to the can. The base is angularly disposed to the side plates to provide an inclined surface for flowing excess paint into the paint can. The holder is adapted for extending into the opening in a paint can such that a bottom edge of the base provides a brush wiping surface for removing excess paint from the brush.

15 Claims, 6 Drawing Figures

FIG. 3
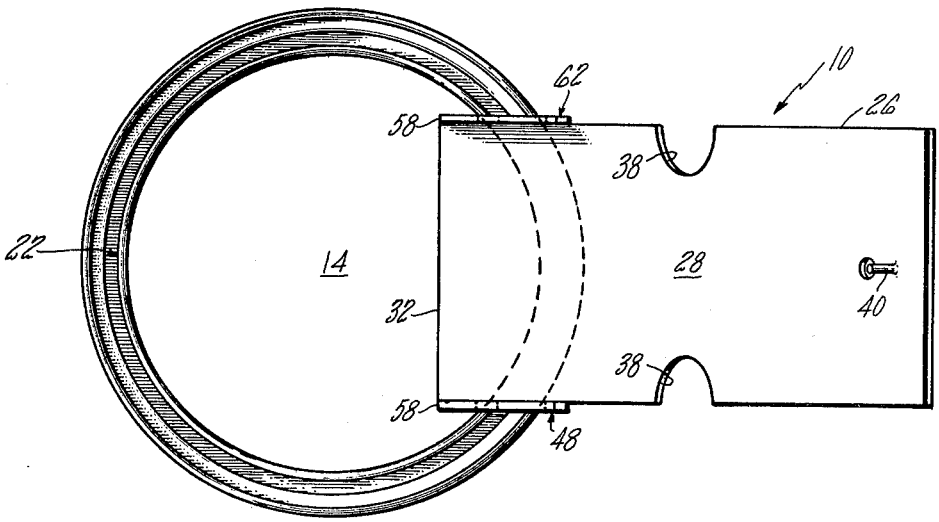
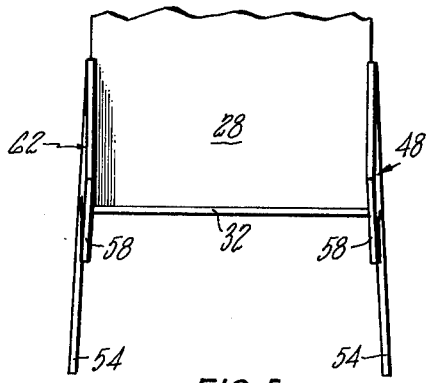
FIG. 5
FIG. 4
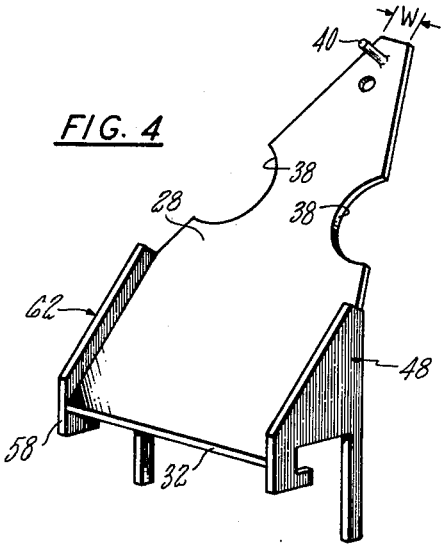

PAINT BRUSH HOLDER AND WIPER

CROSS-REFERENCE TO RELATED APPLICATION

This application is a continuation-in-part of application Ser. No. 28,998, filed 04/11/79, now abandoned.

BACKGROUND OF THE INVENTION

This invention relates to an apparatus for holding and wiping paint brushes and the like and more particularly to an apparatus adapted for being coupled to a paint can for providing a holder for a paint brush and a straight edge for wiping excess paint from the paint brush wherein the excess paint drips into the paint can.

During a typical painting operation a paint brush is continuously dipped into a paint reservoir, typically within a paint can, to adhere paint to the brush for subsequent application to a structure or the like. To avoid dripping paint from the brush, the brush is typically wiped against the inner rim of the paint can to remove excess paint from the brush with the major portion of the excess paint returning to the reservoir of paint. Some of the excess paint also flows into the can lip which can eventually overflow down the outside of the can. Additionally during the painting operation it is frequently required that the brush be put down, typically across the rim of the paint can. This is undesirable in that the handle of the brush becomes coated with paint and the brush is easily dislodged from the can causing paint to spill on the floor or other areas.

Prior art devices have been utilized to attempt to overcome these problems. Typically the prior art devices have been expensive, bulky in size and/or require complicated attachment to the paint cans. Hedglon in U.S. Pat. No. 2,676,730 discloses a brush holder attachment for paint pails and the like having a body adapted for being angularly disposed to the top of a paint can with an angular flange attached to one end of the body and adapted for extending into the interior of a paint can and engaging a rim of the can. Gorrell et al in U.S. Pat. No. 3,948,413 discloses a paint brush holding attachment for paint cans having a main sheet material adapted for being angularly disposed to the top of a paint can with a first leg attached thereto adapted for extending through the access opening of a paint can for providing a wiping surface for the paint brush and for securing the brush for storage. Additionally U.S. Pat. Nos. 3,275,187, 2,567,326 and 2,469,864 disclose additional paint brush holders adapted for use with paint cans or the like.

An additional problem has been encountered in utilization of rollers and roller trays for painting large surfaces. Typically the roller is utilized to paint the major portion of the surface with a paint brush utilized at the edges, corners, etc. During the utilization of the roller, the typical practice is to lay the paint brush in the tray. This is undesirable because the handle is prone to be covered by paint. Additionally, wiping excess paint from the sides of the roller tray tends to generate paint dripping outside the tray.

SUMMARY OF THE INVENTION

An object of the present invention is to provide a paint brush holder adapted for attachment to a paint can for providing a drip surface into a paint reservoir within the can.

A further object is to provide a wiping edge for removing excess paint from a brush wherein all of said excess paint is capable of dripping into the paint reservoir.

A still further object is to provide a paint brush holder adapted for attachment to a roller tray for providing a scraping surface for wiping excess paint from the brush and a scraping surface for cleaning a paint roller.

In accordance with the present invention a paint brush holder and scraper comprises:

a base having a front surface, a back surface, a bottom edge, a top edge, a first side edge and a second side edge, a holder disposed within the base proximate the top edge and projecting from the front surface, a first side plate, fixedly attached to a lower portion of the first side edge, having a top portion extending above the front surface and a bottom portion extending below the bottom surface of the base wherein the bottom portion includes a support leg, having a length adapted for supporting the brush holder along an exterior surface of a point can and means for securing the bottom portion to the rim of a paint can, and a second side plate fixedly attached to a lower portion of the second side edge having a top portion extending above the front surface and a bottom portion extending below the bottom surface of the base wherein the bottom portion includes a support leg having a length adapted for supporting the brush holder along an exterior surface of a paint can and means for securing the bottom portion to the rim of a paint can wherein a first plane passing along the front surface of the base intersects a second plane passing through the length of both of said support legs at an angle of less than ninety degrees.

A primary feature of the present invention is a notched section in the lower portion of the first and second side plates adapted for being inserted into a top opening of a paint can and engaging the rim of the can. Additionally the support legs are adapted for supporting the holder against the exterior surface of the paint can for maintaining the angular placement of the front surface of the base with the top of a paint can. Also the top portion of the side plates cooperate with the front surface of the base to form a channel for constraining lateral motion of a paint brush positioned therebetween. The holder is adapted for engagement with the handle for securing the brush. The bottom edge of the base provides a substantially straight wiping edge for wiping excess paint from a brush. Additionally in one embodiment an arcuately-shaped section within an upper portion of the base is adapted for providing a scraping surface for scraping excess paint from a roller for cleaning the roller or the like.

A primary advantage of the present invention is the relative ease of connecting and disconnecting the brush holder with a paint can. Additionally, the holder is stable during the normal painting operations, including wiping and brush parking due to the support legs pressing against the outside surface of the can and the notch pressing against the rim of the can. Also, the one-piece construction is capable of being utilized on various size paint cans.

The foregoing and other objects, features and advantages of the present invention will become more apparent in the light of the following detailed description of preferred embodiments thereof as discussed and illustrated in the accompanying drawing.

BRIEF DESCRIPTION OF THE DRAWINGS

FIG. 3 is a simplified top view of the present invention engaged in a paint can;

FIG. 4 is a perspective view of an embodiment of the present invention;

FIG. 5 is a partial front view of a further embodiment of the present invention.

DESCRIPTION OF THE PREFERRED EMBODIMENT

Figure 1:
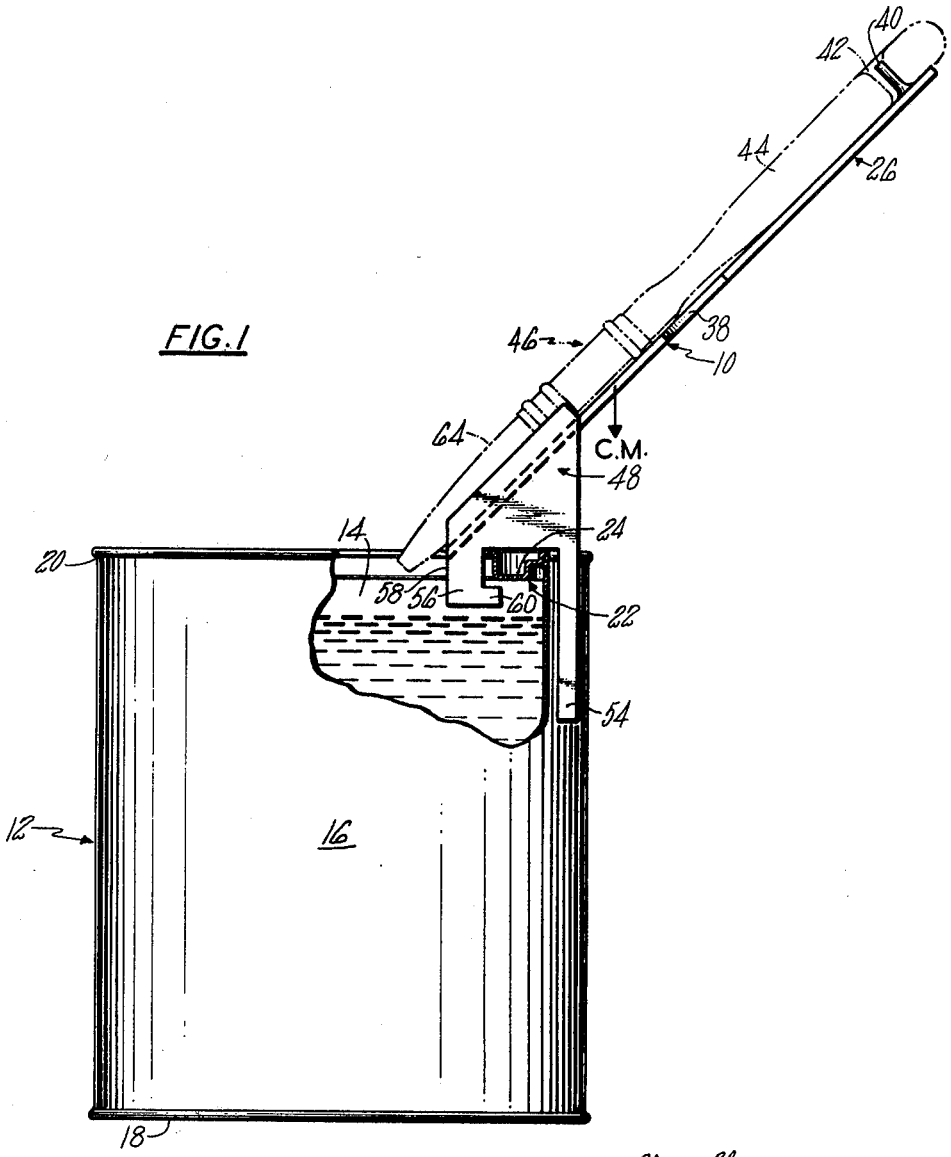
FIG. 1 is a simplified partially cutaway cross-sectional view of a paint brush holder and wiper engaged with a paint can in accordance with the present invention.

Referring now to FIG. 1 wherein a paint brush holder and wiper 10 is shown engaged with a paint can 12. The paint can includes an opening 14, outside wall 16, a bottom 18, a top 20, an annular rim 22 disposed proximate the top annularly enclosing the opening 14 and having a channeled groove 24 disposed therein adapted for receiving a lid (not shown) to form an airtight connection therewith.

Figure 2:
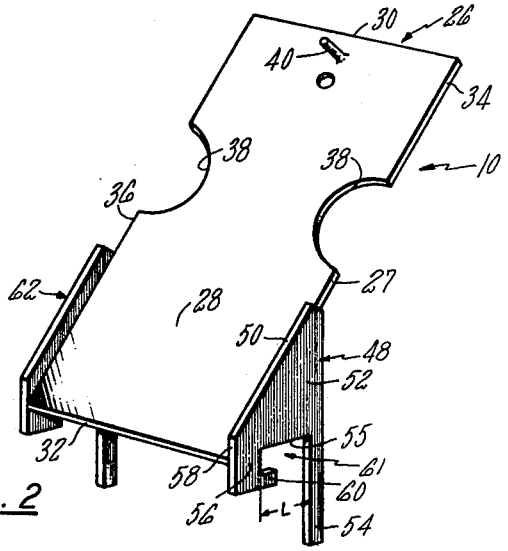
FIG. 2 is a simplified perspective view of the paint brush holder and wiper as shown in FIG. 1.

Referring now to FIGS. 1 and 2, the paint brush holder and wiper 10 includes a base 26 having a front surface 28, a back surface 27, a top edge 30, a bottom edge 32, a first side 34, a second side 36 and a pair of arcuately-shaped roller wiping sections 38 disposed in the first and second side edges. A holder such as pin 40 adapted for engagement with a hole 42 within a handle 44 of a paint brush 46 is disposed in the base proximate the top edge 30 and projecting from the front surface. Disposed proximate the holder pin is an aperture extending through the base.

A first side plate 48 is fixedly attached to a lower portion of the first side edge of the base intermediate the arcuately-shaped wiping section 38 and the bottom edge 32 with a top section 50 extending above the front surface 28 and a bottom section 52 extending below the bottom 18 of the base. The bottom section of the first side plate includes an extended leg 54 projecting along a back edge 56 adapted for extending downwardly from the top 20 along the outside wall 16 of the paint can, a substantially horizontal surface 55, having a length L slightly longer than the width of the rim adapted for overlying the top of the annular rim 22, and a finger 56 projecting along a front edge 58 downwardly from the junction of the first side plate 48 with the base in a substantially parallel relationship with the extended leg 54. A protrusion 60 extends substantially perpendicular to the finger toward the extended leg 54 and cooperates with the finger, the horizontal surface and a portion of the extended leg to define a cavity 61 therebetween adapted for engaging the rim of the paint can to lock the paint brush holder and wiper to the paint can. The finger depends downwardly a sufficient length for the protrusion 60 to partially extend under the rim of a paint can in a close spaced apart relationship therewith, the finger having a length substantially less than the length of the extended leg.

A second side plate 62 substantially identical to the first side plate is fixedly attached to a lower portion of the second side edge of the base intermediate the arcuately-shaped wiping section 38 and the bottom edge wherein the first and second side plates have a substantially parallel, spaced apart relationship to one another. The top section 50 of both the first and second side plates cooperate with the front surface 28 of the base to define a channel therebetween adapted for accommodating the bristles 64 of a paint brush and inhibiting lateral motion thereof. The front surface of the base is angularly disposed to a horizontal plane defined by the top surface of the rim of the paint can to provide an inclined surface to allow paint dripping from the brush to flow down the front surface into the paint can.

Referring now to FIG. 3 which shows a top view of the paint brush holder and wiper attached to a paint can. The base 26 is positioned between the first and second side plates 48, 62 respectively such that the bottom edge extends substantially over the opening 14. It is to be recognized that although FIG. 3 shows the bottom edge 32 substantially in alignment with the front edge 58 of the side plates, the bottom edge may project further or less across the opening in a paint can than the side plates.

Referring again to FIG. 1. In the preferred embodiment the location of the bottom edge 32 with respect to the annular rim 22 is critical for the proper functioning of the finger, the horizontal surface and the extended leg to engage the rim for locking the brush holder to a paint can. The bottom surface must lie substantially in or above the horizontal plane passing through the annular rim of the paint can to maintain the stability of the paint can. The forces generated when the paint brush is wiped against the bottom surface will produce a clockwise torque when the bottom edge is higher than the horizontal plane which will be counterbalanced by the extended legs pressing against the can. This results in the stability of the apparatus. However, if the bottom edge is located below the horizontal plane, a counterclockwise torque is developed during the wiping operation which will tend to disconnect the brush holder from the paint can.

The preferred embodiment is constructed such that the center of mass (C.M. as shown in FIG. 1) of the brush holder lies in a vertical plane which is located outside of the paint can. This is required to maintain mechanical stability of the brush holder during operation. Additionally the holder pin 40 is positioned proximate the top edge 30 such that the center of mass of the brush holder with a paint brush positioned thereon as shown in FIG. 1, will also lie in a vertical plane located outside the paint can.

In operation the brush holder 10 is attached to the paint can by inserting the fingers 56 into the opening 14 and engaging the protrusions 60 under the rim 22. The holder 10 is then rotated about the rim-protrusion engagement until the extended legs contact the outside wall 16 of the paint can. The holder is then securely attached to the can. To remove the holder the top edge of the holder is rotated toward the opening and the protrusions are disengaged from the rim. The bottom edge 32 is adapted for providing a substantially straight edge for wiping excess paint or the like from the brush before the application of the coated brush to a surface. The excess paint drips from the bottom edge into the paint can and not along the outside walls of the can. The paint brush can be stored on the holder by engaging a hole in the handle of the brush with the holder pin. The inclined front surface allows paint to flow from the bristles of the brush along the front surface into the paint can.

It is to be recognized that the paint brush holder and wiper may also be attached to other devices for holding paint such as the side walls of a roller pan. While the painter is using the roller, the paint brush, useful in painting corners, edges, etc. is stored on the holder. Additionally excess paint on the paint brush is removed by wiping the brush along the bottom edge as hereinbefore described rather than along the sides of the roller pan.

An additional feature of the present invention is the arcuately-shaped surfaces 38 within the first and second side edges. The surfaces are adapted for wiping paint or the like from the surfaces of paint rollers especially during paint cleanup.

Referring now to FIG. 4 where an embodiment of the present invention is shown. The first and second side edges along the bottom portion of the base to which the first and second side plates are attached are substantially parallel to one another. The side edges in the upper portion of the base are angularly disposed to one another such that the top edge 30 has a width W substantially less than the width of the bottom edge 32. The tapered side edges provide easier access to attaching and removing the paint brush from the holder pin.

Referring now to FIG. 5 where a further embodiment of the present invention is shown. The first and second side plates 48, 62 are angularly disposed to one another such that the separation between the side plates above the base is less than the separation below the base. Angularly disposing the side plates allows the paint brush holders to be stacked for easy storage of a plurality of holders.

Figure 6:
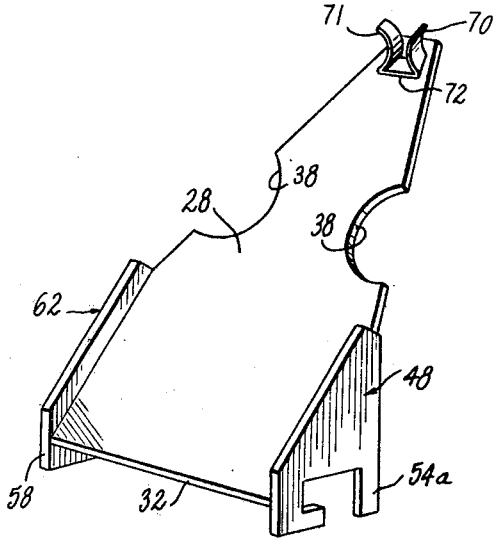
FIG. 6 is a perspective view of an alternative embodiment of the invention.

Additional alternative features of the invention are shown in FIG. 6 wherein pin 40 is replaced by resilient fingers 70, 71, which fingers can be formed integrally with front surface 28 or as part of a spring clip 72.

Further, legs 54*a* are shown as being shorter in length along the can than legs 54 (FIGS. 1 and 2) because it has been found that reasonable stability can be achieved with legs 54*a* of approximately the same length as finger 58.

It is to be recognized that the paint holder may be fabricated of any material and may be sized to accommodate various size paint cans, paint brushes, roller pans or the like.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of my invention, that which I claim as new and desire to secure by Letters Patent of the United States is:

1. A paint brush holder comprising:

a base having a front surface, a back surface, a bottom edge, a top edge, a first side and a second side;

a holder pin disposed within the base proximate the top edge and projecting from the front surface, said holder pin adapted for engagement with a hole in a handle of a paint brush for restraining movement of said paint brush;

a first side plate fixedly attached to a lower portion of the first side of the base wherein a top portion of said first side plate extends above the front surface and a bottom portion extends below the back side of the base wherein the bottom portion includes an extended leg projecting downwardly along a back edge of the first side plate for engagement with an outside wall of a paint can, a finger projecting downwardly along a front edge of the first side plate in a substantially parallel spaced apart relationship with the extended leg, a substantially horizontal section disposed between the finger and the extended leg and a protrusion extending from the finger toward the extended leg wherein the protrusion, the horizontal surface, the finger and a portion of the extended leg form a cavity adapted for engaging the rim of a paint can for securing the holder to the paint can; and a second side plate substantially identical to the first side plate fixedly attached to a lower portion of the second side of the base wherein a top portion of said side plate extends above the front surface of the base and cooperates with the top portion of the first side plate and the front surface of the base to define a channel therebetween adapted for inhibiting lateral motion of a paint brush attached to the holder.

2. The invention in accordance with claim 1 wherein the front surface of the base is angularly disposed to a plane passing through a rim of a paint can to provide an inclined surface for excess paint from a paint brush or the like to flow into a paint can.

3. The invention in accordance with claim 1 further including an arcuately-shaped roller wiping surface disposed in the first side of the base.

4. The invention in accordance with claim 3 further including an arcuately-shaped roller wiping surface disposed in the second side of the base.

5. The invention in accordance with claim 1 wherein the first and second sides are substantially parallel to one another along a bottom portion of the base and are angularly disposed to one another along a top portion of the base such that the top edge has a width substantially less than a width of the bottom edge of the base.

6. The invention in accordance with claim 1 wherein the bottom edge cooperates with the first and second side plates to provide a wiping edge adapted for removing excess paint from a paint brush and for providing a drip surface adapted for dripping said excess paint into a reservoir of paint within a paint can.

7. The invention in accordance with claim 6 wherein the paint brush holder is adapted for engagement with a paint can such that the bottom edge lies in a horizontal plane passing through the rim of the paint can.

8. The invention in accordance with claim 6 wherein the paint brush holder is adapted for engagement with a paint can such that the bottom edge lies above a horizontal plane passing through the rim of the paint can.

9. The invention in accordance with claim 1 wherein the paint brush holder has a center of mass located in a vertical plane positioned outside the paint can.

10. The invention in accordance with claim 9 wherein the holder pin is disposed within the base proximate the top edge such that when engaged with a paint can, the paint brush holder and a paint brush attached to the holder pin and positioned along the base will have a center of mass located in a vertical plane positioned outside the paint can.

11. The invention in accordance with claim 1 wherein the first and second side plates are disposed in a substantially parallel spaced apart relationship to one another.

12. The invention in accordance with claim 1 wherein the first and second side plates are angularly disposed to one another such that the separation between the top portions is less than the separation between the bottom portions.

13. In combination a paint can having a top, a bottom, an outside wall, an annular rim disposed proximate the top and enclosing an opening within the top and a paint brush holder having:

a base having a front surface, a back surface, a bottom edge, a top edge, a first side and a second side;

a holder pin disposed within the base proximate the top edge and projecting from the front surface, said holder pin adapted for engagement with a hole in a handle of a paint brush for restraining movement of said paint brush;

a first side plate fixedly attached to a lower portion of the first side of the base wherein a top portion of said first side plate extends above the front surface, and a bottom portion extends below the back side of the base wherein the bottom portion includes an extended leg projecting downwardly along a back edge of the first side plate adapted for engagement with an outside wall of a paint can, a finger projecting downwardly along a front edge of the first side plate in a substantially parallel spaced apart relationship with the extended leg, a substantially horizontal section disposed between the finger and the extended leg and a protrusion extending from the finger toward the extended leg wherein the protrusion, the horizontal surface, the finger and a portion of the extended leg form a cavity adapted for engaging the rim of a paint can for securing the holder to the paint can; and a second side plate substantially identical to the first side plate fixedly attached to a lower portion of the second side of the base wherein a top portion of said side plate extends above the front surface of the base and cooperates with the top portion of the first side plate and the front surface of the base to define a channel therebetween adapted for inhibiting lateral motion of a paint brush attached to the holder.

14. A paint brush holder comprising: a base, a pair of side plates disposed on opposite sides of said base and extending in a plane generally perpendicular to said base each said side plate having a projecting leg intended for engagement with an outside wall of a paint can and a finger spaced from said leg with a protrusion extending toward said leg whereby the finger and protrusion in cooperation with said leg form a cavity adapted for engaging the rim of the paint can for securing the holder to the paint can with the base being disposed at an angle to a plane passing through the rim of the paint can, and means on said base engageable with a paint brush to restrain movement of a paint brush placed thereon.

15. The paint brush holder of claim 14 wherein the side plates extend above as well as below said base, the base is of sufficient length to extend inwardly beyond the rim of a paint can so as to direct paint from a brush into the can and the length of each leg of a side plate is greater than the length of the finger.

* * * * *

UNITED STATES PATENT AND TRADEMARK OFFICE

CERTIFICATE OF CORRECTION

PATENT NO. : 4,275,818

DATED : June 30, 1981

INVENTOR(S) : Robert Franklin Church

It is certified that error appears in the above—identified patent and that said Letters Patent is hereby corrected as shown below:

Column 6, line 1, wherein the words "plate for engagement" should be --plate adapted for engagement.

Signed and Sealed this

*Seventeenth* Day of *November 1981*

[SEAL]

*Attest:*

GERALD J. MOSSINGHOFF

*Attesting Officer* *Commissioner of Patents and Trademarks*